US008671806B2

(12) United States Patent
Lindblom

(10) Patent No.: US 8,671,806 B2
(45) Date of Patent: Mar. 18, 2014

(54) WRENCH/TOOL SYSTEM WITH SEPARATE HANDLE AND INTERCHANGEABLE WRENCH/TOOL ENDS

(75) Inventor: Peter Dorn Lindblom, Zionsville, IN (US)

(73) Assignee: Peter D. Lindblom Jr., Zionsville, IN (US)

( * ) Notice: Subject to any disclaimer, the term of this patent is extended or adjusted under 35 U.S.C. 154(b) by 0 days.

(21) Appl. No.: 13/449,277

(22) Filed: Apr. 17, 2012

(65) Prior Publication Data

US 2013/0098213 A1 Apr. 25, 2013

Related U.S. Application Data

(60) Provisional application No. 61/517,317, filed on Apr. 18, 2011.

(51) Int. Cl.

| | |
|---|---|
| ***B25B 23/16*** | (2006.01) |
| ***B25G 1/00*** | (2006.01) |
| ***B25B 13/46*** | (2006.01) |
| ***B25B 13/02*** | (2006.01) |

(52) U.S. Cl.
USPC ..... 81/177.1; 81/63.2; 81/177.3; 81/124.1

(58) Field of Classification Search
USPC ..... 81/177.1, 63.1, 177.3, 124.1, 124.2, 32
See application file for complete search history.

(56) References Cited

U.S. PATENT DOCUMENTS

| | | | | |
|---|---|---|---|---|
| 4,791,837 | A * | 12/1988 | Main | 81/63.1 |
| 5,970,553 | A * | 10/1999 | Lin | 7/143 |
| 2010/0263219 | A1 * | 10/2010 | Kempker et al. | 30/337 |

* cited by examiner

*Primary Examiner* — Monica Carter
*Assistant Examiner* — Danny Hong

(57) ABSTRACT

This invention is a new beginning for AN wrench users. No more uncomfortably thin AN or Bonney wrenches are needed. This wrench/tool system with separate, ergonomic handle is loaded with features designed for comfort. The separate handle is specifically designed with contoured finger grips, and gently radiused back edge resting against the palm of the user's hand. These are features that will provide the user all-day comfort. In addition, with the common blade of the wrench/tool ends, fitting the matching receiving groove of the handles, wrench/tool ends and handles of differing styles can be added, and upgraded to build a set of wrench/tool ends and handles to meet every need.

3 Claims, 12 Drawing Sheets

WRENCH/TOOL SYSTEM WITH SEPARATE HANDLE AND INTERCHANGEABLE WRENCH/TOOL ENDS

CROSS-REFERENCE TO RELATED APPLICATIONS

This application is related to Provisional Patent Application No. 61/517,317 under customer number 97995, Filed on or about, Apr. 18, 2011

STATEMENT REGARDING FEDERALLY SPONSORED RESEARCH OR DEVELOPMENT

This invention was not created in conjunction with any federally sponsored program for research or development.

REFERENCE TO A SEQUENCING LIST

Not applicable

BACKGROUND OF INVENTION

In the field of automotive and aircraft maintenance, technicians and mechanics use wrenches commonly known as "AN" wrenches or "Bonney" wrenches. "AN" stands for Army-Navy, part of the mil-spec nomenclature for aerospace hardware. These wrenches are also commonly used by mechanics in all forms of racing and motorsports, from boat racing to drag racing, to Formula One and IndyCar racing. In addition, there is a large group of people who build custom cars, boats, trucks and even airplanes who use these types of wrenches. This style of wrench is generally used for loosening and tightening hydraulic and pneumatic hose fittings, commonly known as "AN" fittings.

These "AN" wrenches are typically machined from aluminum in a one piece unit, such that each size of wrench is a complete unit with handle and working end of wrench being a one piece unit. "AN" wrenches are typically about ⅜" thick. "Bonney" wrenches serve the same purpose, but are typically made of steel and are very thin, approximately ⅛" thick. The thin "Bonney" wrenches, and the square edges for the aluminum AN wrenches can be uncomfortable to use over an extended period of time.

This invention, the wrench/tool system with interchangeable tool ends, addresses the issues of comfort with an ergonomically designed handle.

SUMMARY OF THE INVENTION

In order to solve the comfort issues that arise from extended use of the current art "AN" wrenches and "Bonney" wrenches, this invention brings an ergonomic handle together with the interchangeable wrench/tool ends in a system that is both comfortable to use and gives the user the opportunity to expand the number and style of wrench/tool ends that can be used with the handle(s).

The complexity and features of the handle make it impractical to be produced for every size and style of wrench. This invention solves this problem by the use of a separate, feature-rich handle, contoured for a comfortable grip, together with interchangeable wrench/tool ends that lock into place in the receiving groove of the handle.

DETAILED DESCRIPTION OF INVENTION

Figure 1:
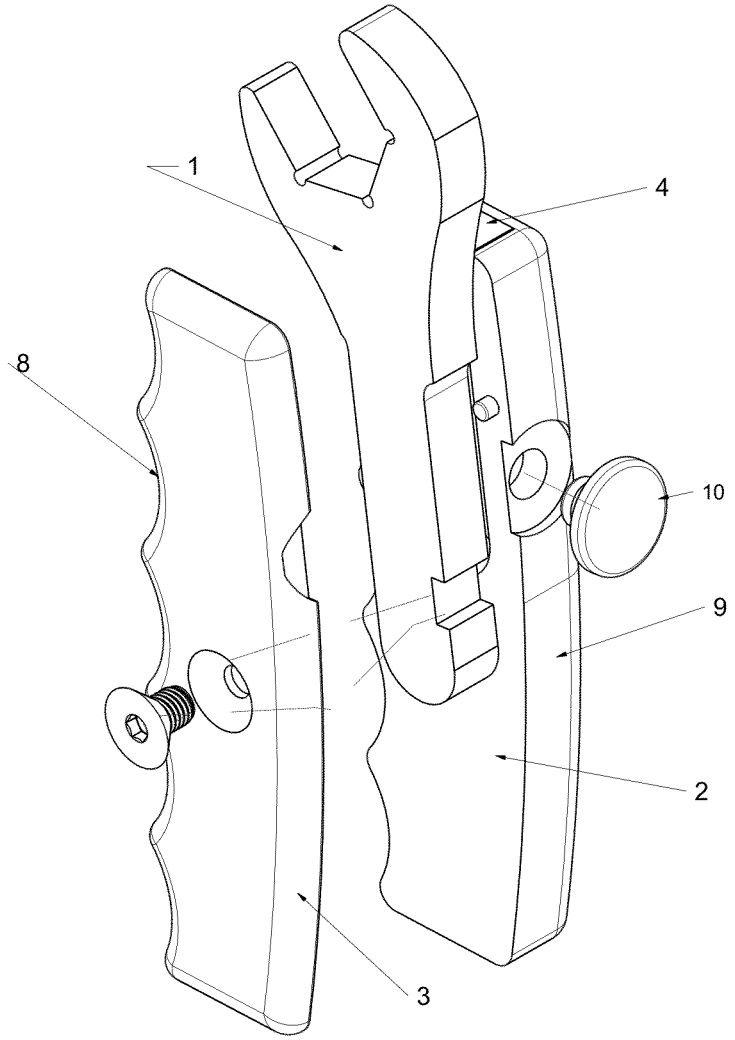
FIG. 1
Complete Wrench/Tool Assembly
Areas 1) Wrench/tool end, 2) Handle Body, 3) Handle Cover, 4) Receiving Groove, 8) finger contours, 9) radius of back edge (against palm of hand) 10) lock button FIG. 2
Handle Body
Areas 2) Handle Body, 3) Handle Cover, 4) receiving groove
FIG. 3
Handle Body with cover
Areas 2) Handle Body, 3) Handle cover, 4) receiving groove
FIG. 4
Handle with Cover Front view
Areas 2) Handle Body, 3) Handle Cover, 4) receiving groove
FIG. 5
Wrench/tool "blade" end only
Areas 5) Blade end, 6) Top of Blade
FIG. 6
Dash 12 (size) AN wrench/tool end
Areas 5) Blade end, 7) "working" end of wrench/tool
FIG. 7
Dash 6 (size) AN wrench/tool end
Areas 5) Blade end, 7) working end of wrench/tool
FIG. 8
Dash 8 (size) AN wrench/tool end
Areas 5) blade end, 7) working end of wrench/tool
FIG. 9
Dash 10 (size) AN wrench/tool end
Areas 5) blade end, 7) working end of wrench/tool
FIG. 10
Dash 16 (size) AN wrench/tool end
5) Blade end, 7) working end of wrench/tool
FIG. 11
Cylindrically shaped handle
Areas 4) Receiving groove
FIG. 12
Scraper-style tool end
Areas 5) Blade end, 7) Working end of scraper-style tool
Figure 3:
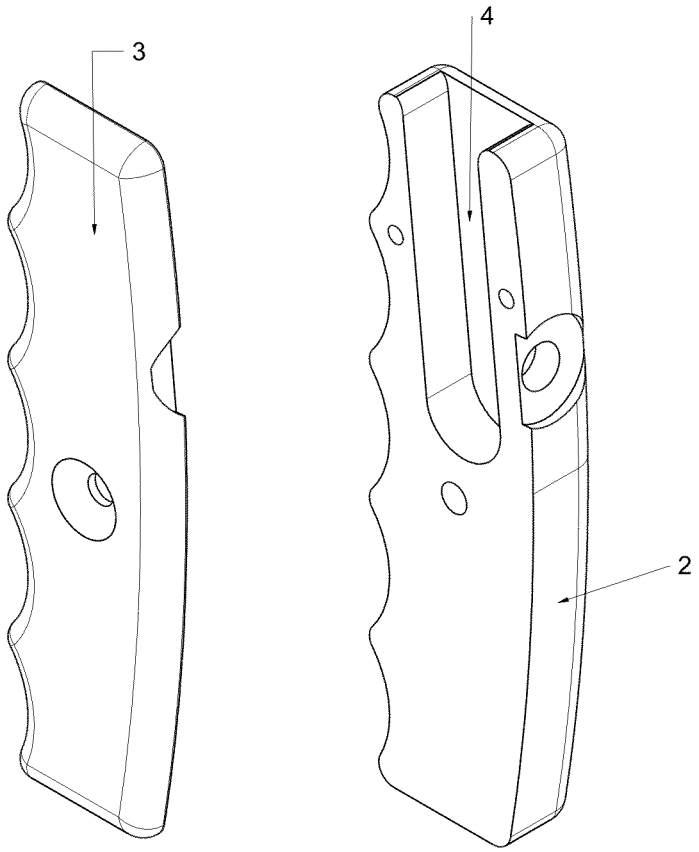
Figure 4:
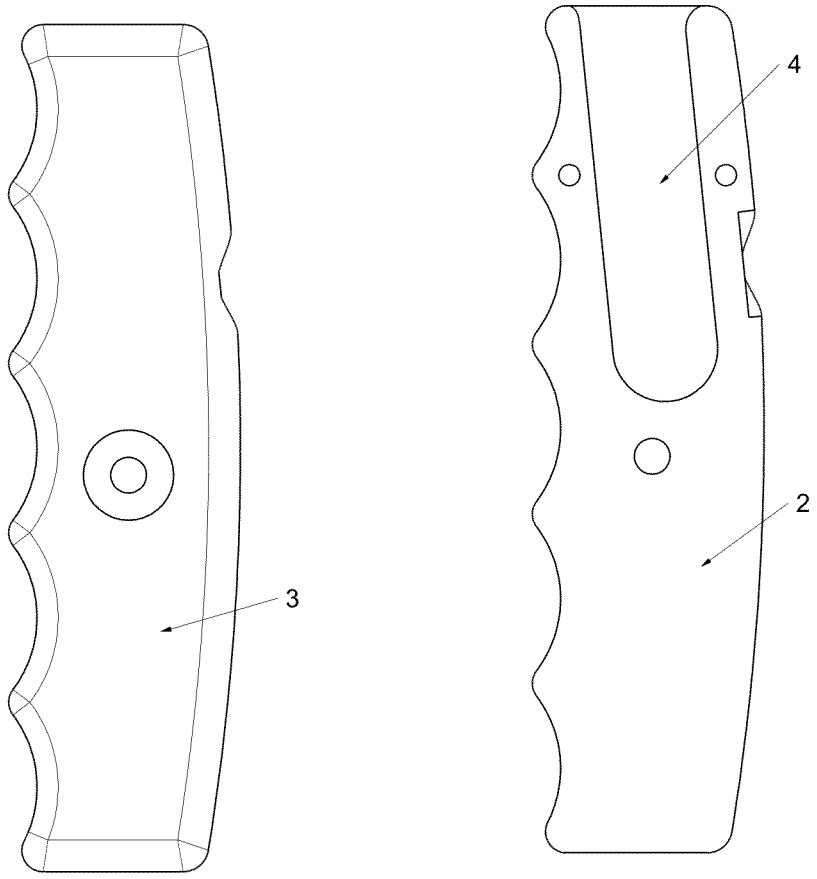
Figure 11:
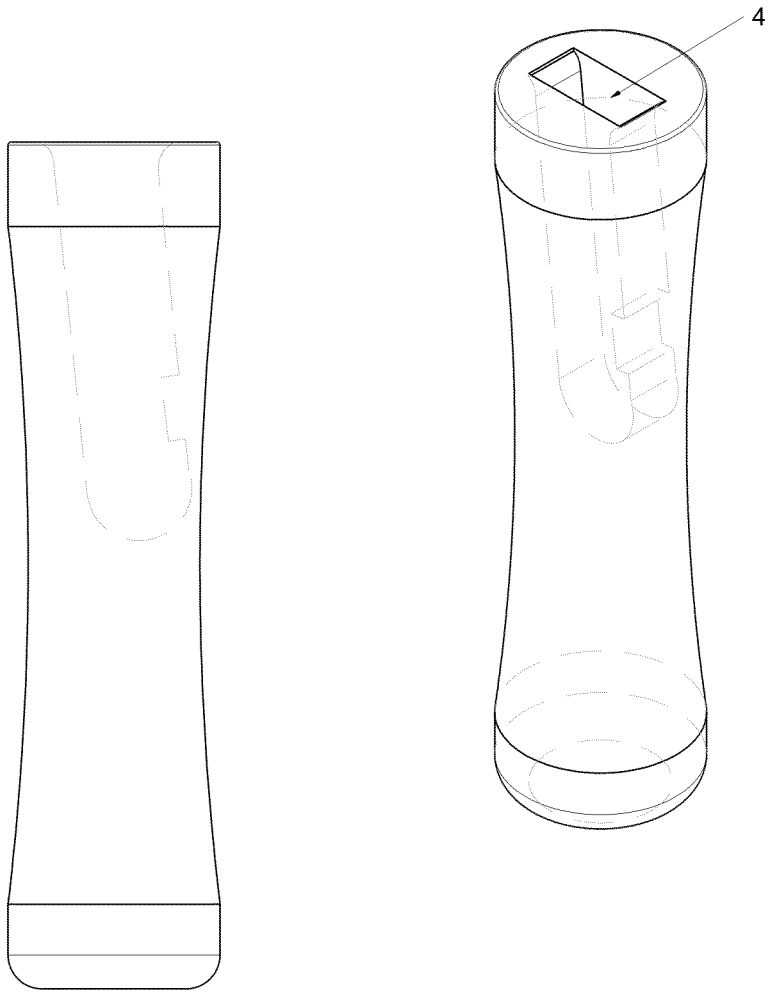
Figure 12:
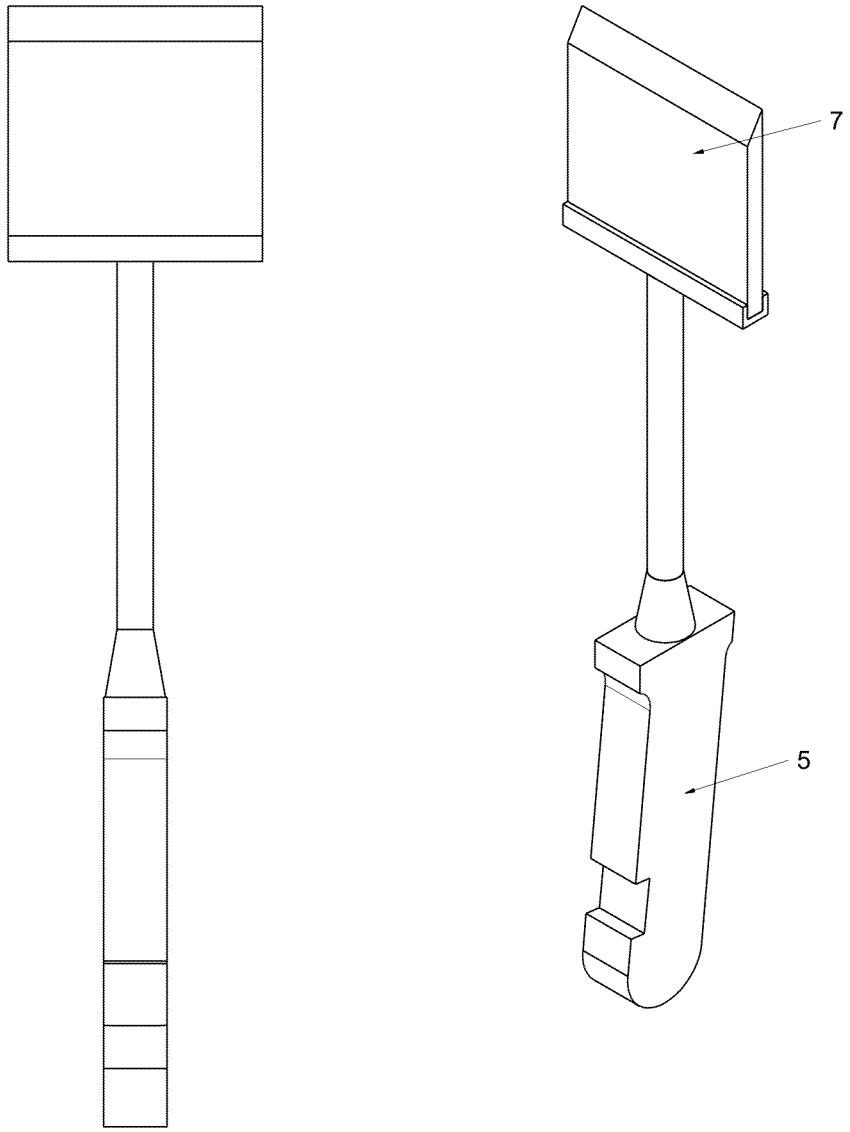

The present invention is a wrench/tool system. This tool system, FIG. 1, consists of a separate handle assembly consisting of the handle body (2), handle cover (3) and lock button (10), with interchangeable wrench/tool ends (1) which are inserted, and locked via a lock button (10) into a receiving groove (4) at the top end of the handle. The handle assembly, FIG. 3, with the receiving groove (4), is the foundation of the tool system. Any of the interchangeable tool ends (FIGS. 6, 7, 8, 9, 10, 12, and future tool designs) can be used with this "common" handle(s). FIG. 1, shows the ergonomic (standard) handle with wrench/tool end in an exploded view. Note the finger contours (8) and curved edge (9) opposite of finger contours. FIG. 11 shows an optional cylindrical handle, with the common receiving groove (4)

Operation

Figure 2:
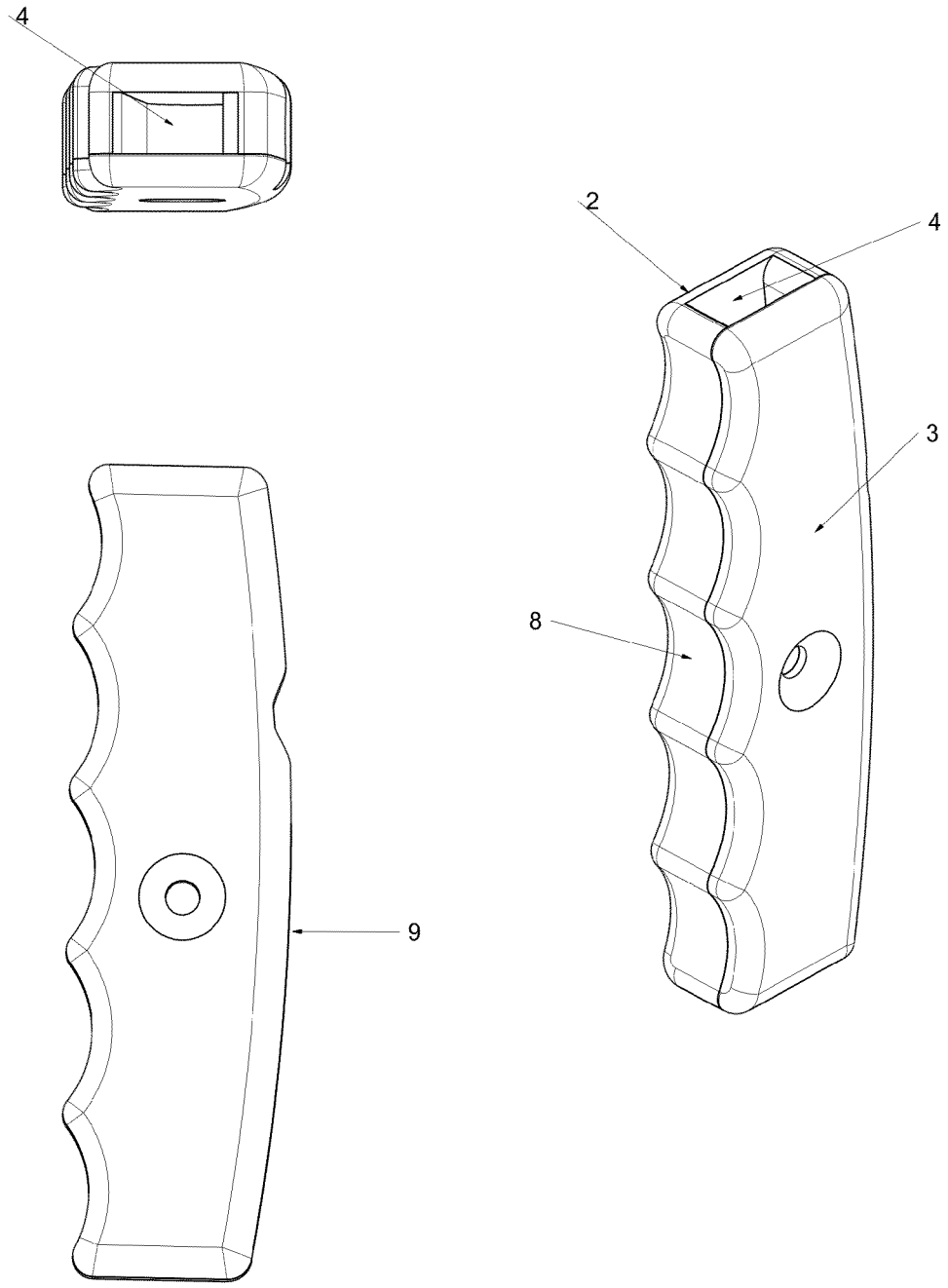
Figure 6:
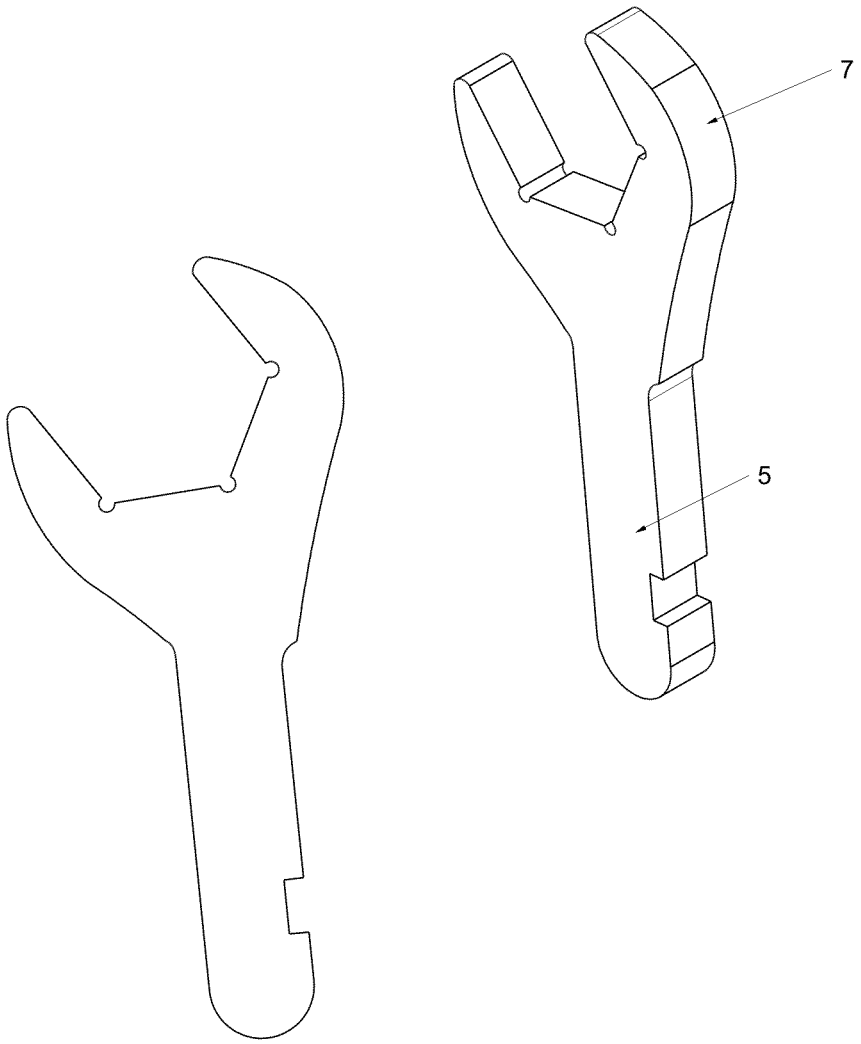
Figure 7:
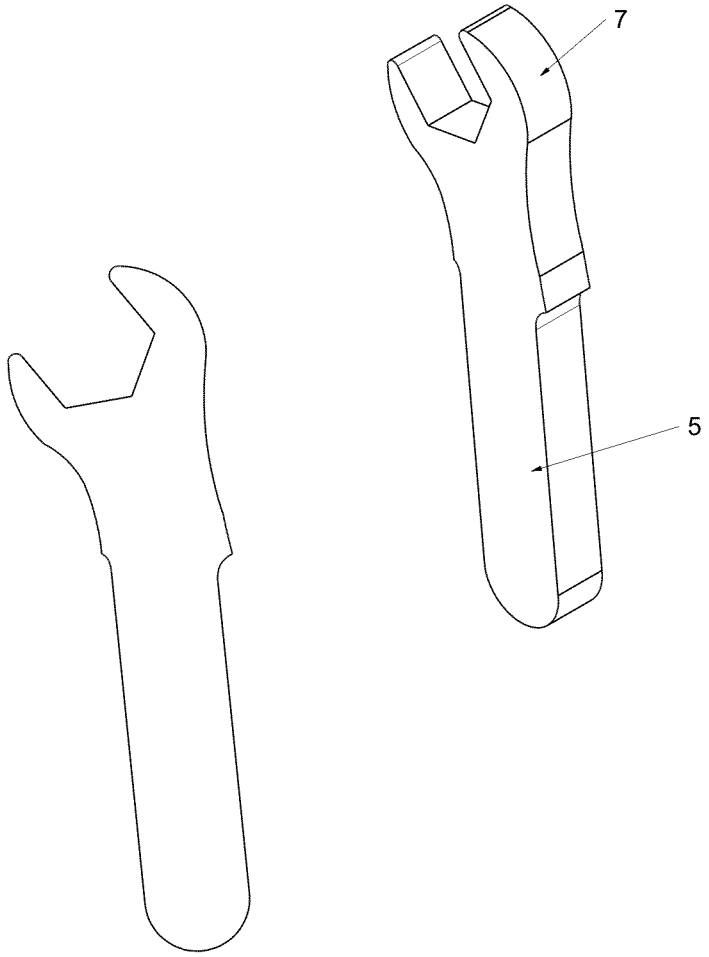
Figure 8:
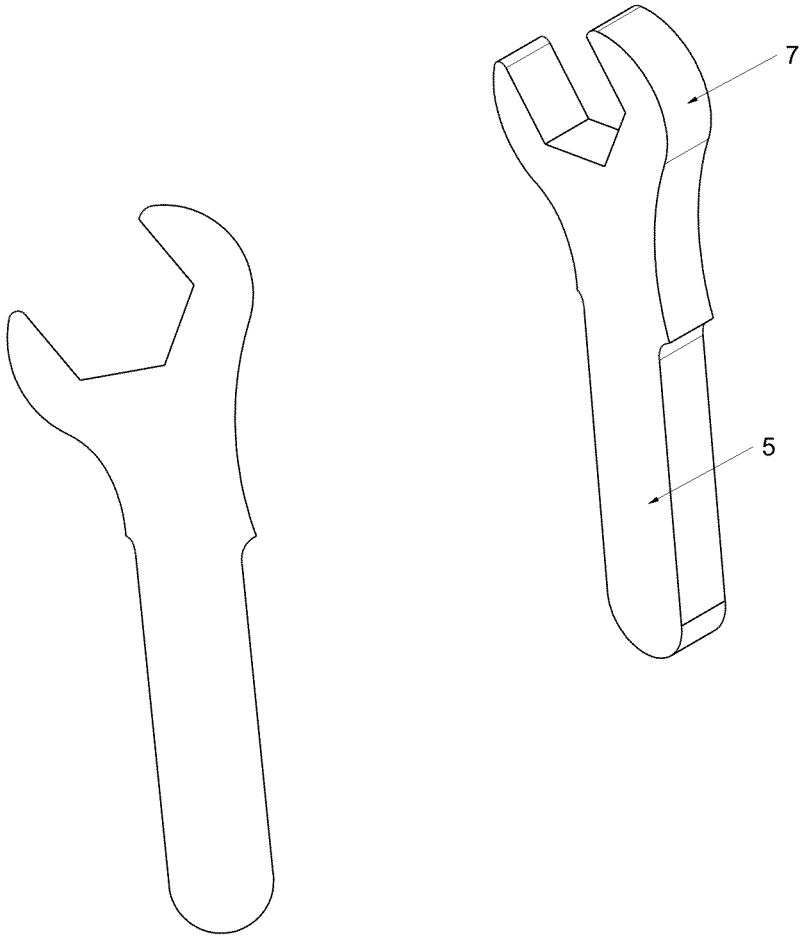
Figure 9:
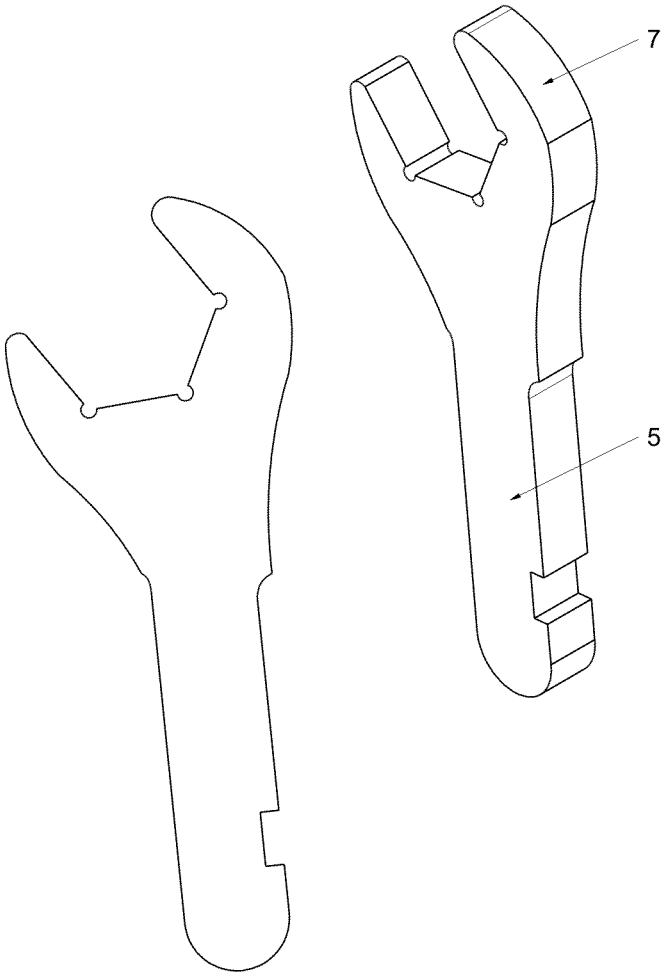
Figure 10:
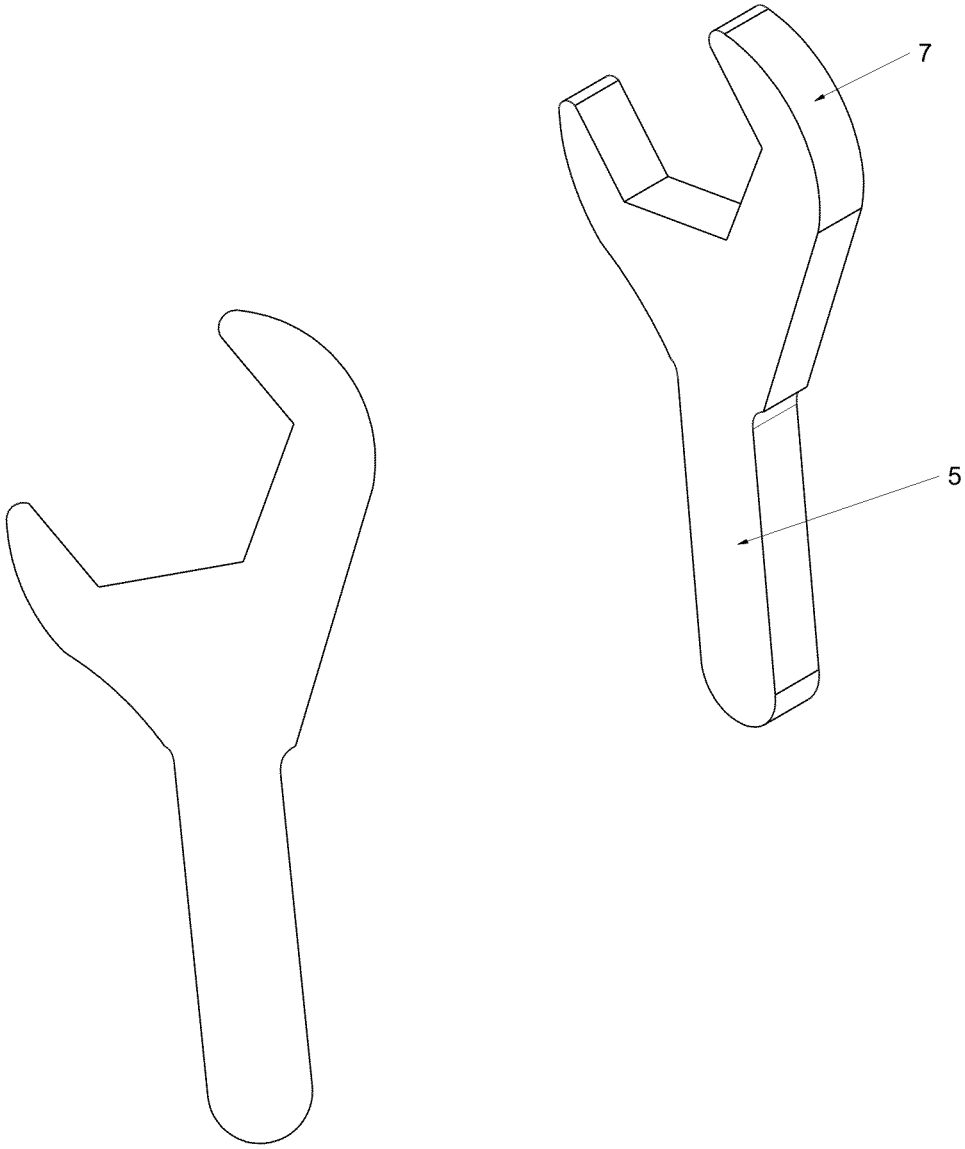

In service, this is wrench/tool system operates as any other normal AN wrench or other desired handle, FIG. 2, and insert the "blade end" FIG. 6 area 5, of the wrench/tool end, into the receiving groove of the handle, FIG. 2 area 4, and lock wrench/tool end into place with the lock button, FIG. 1 area 10. Once the wrench/tool end is locked into place in the handle, the tool is ready to be used as any standard "AN" wrench, or other open-end wrench would be used.

Generally speaking, the aluminum "AN" wrenches are used in lower torque application to tighten/loosen aluminum AN fittings. Steel wrench tool ends could be used at appropriately higher torque levels.

Construction

Current design is for the components of the handle and wrench/tool ends to be made of aircraft grade aluminum alloy. The parts are CNC machined, deburred, and/or tumbled to an appropriate and desired finish, then anodized for durability, and wear resistance. Current design lends itself most readily to being machined on a CNC mill or other type of similar machining equipment. This specification should not, and does not limit method of manufacture. The handle lends itself to being made from injection molded plastic, or from a molded material such as carbon fiber. Current design shows a 2 piece handle, but this specification should not, and does not limit handle to being made in two separate pieces. All parameter of the design can be readily adapted to a one piece molded product.

Current design shows that the two handle halves (cover and body), FIG. 1 area 2 and 3, are aligned by dowel pins (near top edge) mated together and secured with a fastener. Current design is for the lock button (10) to be secured in its bore with a ball detent spring which indexes in a groove machined on the lock button minor diameter which corresponds with the counter-bore in the handle body. While this current design is a "manual" lock mechanism, this specification does not, and should not limit design to a "manual" button, as an "automatic" or other locking mechanism will be utilized in the future.

The wrench/tool ends will also initially be CNC machined from aircraft grade aluminum alloy. A combination of laser cutting and finish machining can also be used to cut these wrench ends from aluminum plate. This specification does not, and should not limit wrench/tool ends from being made from other materials, or by other methods.

This specification does not, and should not limit, the method of construction or the material used in the manufacture of the components of the present invention, which is a wrench/tool system with interchangeable tool ends.

The present invention can also function at a variety of scales (of size) and torque levels, and therefore should not be limited to a certain material or method of construction. For example, there are many low torque applications in which the handle could be made from injection molded plastic. While other uses may require a handle and a wrench/tool end to be made from steel, or a non-sparking material, thus allowing for use in fuel tanks and other applications where any spark may pose a serious threat to the safety of the operator.

The current design shows a particular length of the handles, but this specification does not, and should not, limit the scaling of the size of components of the wrench/tool system. Inventor will scale the size up or down depending on the application. For example, a handle and corresponding wrench/tool ends may be half the size of the current handle design. This would make a scaled-down wrench/tool system that retains the finger contours and back edge profile (radius) while maintaining the functions, look, and design features as shown in the current design.

Figure 5:
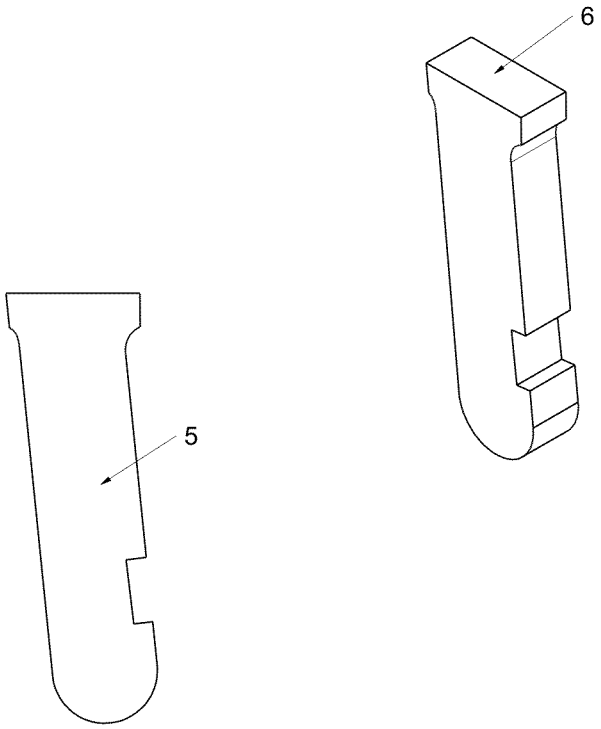

To reiterate, while much time has been spent detailing the current design, which happens to include six examples of "AN Wrench" style tool ends, this specification does not, and should not limit the wrench/tool system to these tools. There are any number of examples of tools that will be adapted to the common "blade" end, FIG. 5, for use in the handles with the corresponding receiving groove, FIG. 2 area 4, including a straight scraping tool such as the one in depicted in FIG. 12.

The embodiment of the invention in which an exclusive property or privilege is claimed are defined as follows:

1. An interchangeable tool comprising:

a plurality of tool ends, each of the tool ends comprising a tool end body with a receiving groove at an end thereof; a handle assembly, the handle assembly comprising a handle body and a handle cover, the handle body and the handle cover each defining an outer side surface, an inner side surface, a top surface and a bottom surface, the handle body and the handle cover further each comprising a corresponding receiving channel for receiving the tool end body of one of said plurality of tool ends, a securing counterbore formed on a respective one of said top surfaces and corresponding to each other, a first bore formed at a mid-portion of said outer side surface of the handle cover and a second bore formed on said top surface of the handle body within the counterbore of the handle body; and a locking mechanism comprising a locking button configured to be received in said first bore and extending through said receiving groove; a securing button configured to be received in said second bore and engaging said correspondingly securing counterbore to secure the handle body and the handle cover together; and wherein the plurality of tool ends are interchangeable by disengaging the lock and the securing buttons.

2. The interchangeable tool of claim 1, wherein the handle assembly further comprises finger contours on the bottom surfaces.

3. The interchangeable tool of claim 1, wherein the handle body and the handle cover are aligned by pins.

* * * * *